US005997645A

United States Patent [19]

Grimmel et al.

[11] Patent Number: 5,997,645

[45] Date of Patent: Dec. 7, 1999

[54] INSERTS FOR STRIPE COATING

[75] Inventors: Kai Grimmel, Hilden, Germany; Mark R. Strenger, Woodbury, Minn.

[73] Assignee: 3M Innovative Properties Company, Saint Paul, Minn.

[21] Appl. No.: 08/449,823

[22] Filed: May 24, 1995

[51] Int. Cl.[6] ..... B05C 11/00

[52] U.S. Cl. ..... 118/410; 425/461

[58] Field of Search ..... 427/286, 356; 425/461, 466, 467; 118/410, 411, 419, 429

[56] References Cited

U.S. PATENT DOCUMENTS

| | | | |
|---|---|---|---|
| 3,413,143 | 11/1968 | Cameron et al. | 117/120 |
| 3,941,902 | 3/1976 | Wennerblom et al. | 427/172 |
| 4,050,410 | 9/1977 | Stroszynski | 118/410 |
| 4,293,517 | 10/1981 | Knox | 425/461 |
| 4,411,614 | 10/1983 | Feathers | 118/412 |
| 4,416,214 | 11/1983 | Tanaka et al. | 118/140 |
| 4,440,809 | 4/1984 | Vreeland | 427/356 |
| 4,643,127 | 2/1987 | Wanke | 118/413 |
| 4,667,879 | 5/1987 | Muller | 239/133 |
| 4,985,284 | 1/1991 | Shibata et al. | 427/428 |
| 5,033,403 | 7/1991 | Mladota | 118/261 |
| 5,209,954 | 5/1993 | Takahashi et al. | 427/430.1 |
| 5,234,330 | 8/1993 | Billow et al. | 425/467 |
| 5,389,150 | 2/1995 | Baum et al. | 118/410 |

FOREIGN PATENT DOCUMENTS

| | | |
|---|---|---|
| 0 545 259 A1 | 6/1993 | European Pat. Off. . |
| 0 595 295 A1 | 4/1994 | European Pat. Off. . |
| 0 577 539 A1 | 5/1994 | European Pat. Off. . |
| 1.297.769 | 5/1962 | France . |
| 2 228 685 | 1/1974 | Germany . |
| 39 07 846 A1 | 9/1989 | Germany . |
| 3906070 A1 | of 1990 | Germany . |
| 1024792 | 4/1966 | United Kingdom . |
| 2 124 107 | 2/1984 | United Kingdom . |

OTHER PUBLICATIONS

Ortman, Bryan J and Donigan, Douglas W., Mechanism and prevention of coat weight nonuniformity due to high speed blade coating, Sep. 1992 Tappi Journal, pp. 161–169.

Li, Alfre C. and Burns, James R., Effects of air entrainment on coat weight distributions with an enclosed pond applicator, Sep. 1992 Tappi Journal, pp. 151–159.

Hwang, S.S., Hydrodynamic Analyses of Blade Coaters, Chemical Endineering Science, vol. 34, pp. 181–189.

*Primary Examiner*—Brenda A. Lamb

*Attorney, Agent, or Firm*—Michaele A. Hakamaki

[57] ABSTRACT

A coating insert used within a coating assembly for defining at least one edge of coating fluid as it is applied to a substrate moving past the coating assembly is disclosed. The coating assembly includes a trough having first and second transverse ends. At least one coating insert is inserted within the trough to define an edge of coated fluid on a substrate. The coating insert, having one or two edge-defining surfaces, is positioned within the trough. The first end of the edge-defining surface is closer to the adjacent transverse end of the trough than the second end of the edge-defining surface. The top face of the coating insert may also include a second edge-defining surface having first and second ends that may define another edge of coated fluid on a substrate.

15 Claims, 5 Drawing Sheets

INSERTS FOR STRIPE COATING

TECHNICAL FIELD

The present invention relates to devices for applying coating material to a web. More particularly, the present invention relates to applying coating material to a web in zones or stripes that are adjacent to uncoated zones across the width of the web.

BACKGROUND OF THE INVENTION

Coating is the process of applying a layer of fluid, typically referred to as a coating material or coating solution, to a substrate. The substrate may be provided in many forms, but is often provided in the form of a long continuous sheet of material wound into a roll, commonly referred to as a web. Typical substrate materials include plastic film, woven or non-woven fabric, or paper. One method of coating the substrate involves unwinding the web from the supply roll, applying a liquid layer of coating material to the web, solidifying the liquid layer on the web, and rewinding the coated web into a roll.

After the coating material is applied, it can remain a liquid such as in the application of lubricating oil to metal in metal coil processing or the application of chemical reactant to activate or chemically transform a substrate surface. Alternatively, the coating material can be solidified by drying if it contains a volatile liquid, or can be cured by heat, ultraviolet radiation, or the like, or treated in some other way to leave behind a solid coated layer. Examples of typical coating materials include paints, varnishes, adhesives, photochemicals, and magnetic recording media. Methods of applying coatings to webs are discussed in Cohen, E. D. and Gutoff, E. B., *Modern Coating and Drying Technology,* VCH Publishers, New York 1992 and Satas, D., *Web Processing and Converting Technology and Equipment,* Van Vortstrand Reinhold Publishing Co., New York 1984, and include knife coaters.

Knife coating involves passing the coating material between a stationary solid member, a knife, and the web so that the clearance between the knife and the web is less than twice the thickness of the applied coating material. The coating material is sheared between the web and the knife, and the thickness of the applied coating material depends to a great extent on the height of the clearance. Alternatively, knife coaters can apply a coating directly to a roller, which can subsequently transfer the coating to a web.

One feature which distinguishes various knife coaters is how the coating material is supplied to the clearance between the knife and the web. Some different types of knife coaters include die-fed knife coaters and trough-fed knife coaters such as a cross flow knife coater. With each of these types of coaters, the coating material may be applied across the entire transverse width of the web, or may be applied in stripes or zones across the width of the web.

Die-fed knife coaters, as illustrated in FIG. 1, receive coating material from a narrow slot which, in conjunction with an upstream manifold, distributes evenly across the web the flow of coating material feeding the knifing passage. The die includes two plates sandwiched together with a shim or a depression in one plate forming the slot passage. In order to apply the coating material in stripes or zones with a die-fed knife coater, the slot passage is typically blocked at specific areas so that the coating material cannot exit the slot passage in those areas. The coating material can only exit the slot passage at the unblocked areas, thereby providing the desired pattern of coated and uncoated zones on the web. The slot passage may be blocked either by inserting shims into the slot passage or by covering specific parts of the slot passage, such as with a piece of tape or other covering material.

Trough-fed knife coaters, shown in FIGS. 2A and 2B, receive coating material from a wide slot, or trough, which is fed by a narrow slot and manifold to provide even flow distribution across the web. In order to apply the coating material in stripes or zones with a trough-fed knife coater, the trough is typically blocked at specific areas so that the coating material cannot exit the trough in those areas. The coating material can only exit the trough at the unblocked areas, thereby providing the desired pattern of coated and uncoated zones on the web. The trough may be blocked by covering specific parts of the trough, such as with a piece of tape or other covering material. However, because the web may contact with this tape as it moves past the trough during the coating process, undesirable scratching and damage of the web may occur.

Alternatively, the trough may be blocked by inserting dams into the trough, where each dam is the same width as the area to remain uncoated on the web. The sides of the dams correspond to the edges between coated and uncoated areas on the web and are parallel to the machine direction. When dams of this type are used, it is common for an edge bead of coating material to form at the sides of the dams, which then tends to flow onto the upper surface of the dam that is in contact with the web. Any coating material that has flowed onto the upper surface of the dam may then transfer to areas of the web that were to remain free of coating material. When this happens, the web product often will not meet the necessary manufacturing specifications and must be discarded.

Cross flow knife coaters, shown in FIG. 3, receive coating material from a wide slot, or trough, which is fed at one transverse end of the trough and flows across the width of the trough to the opposite transverse end of the trough to provide even flow distribution across the web. Any coating material that is not coated onto the web surface exits the end of the trough opposite the supply end. In order to apply coating material in stripes or zones with a cross flow knife coater, the trough is typically blocked at specific areas with tape or dams in the same manner as the trough-fed knife coater so that the coating material cannot exit the trough in those areas. As with the trough-fed knife coater, it is difficult to apply coating material in stripes or zones with a cross flow knife coater using the current methods of stripe coating.

SUMMARY OF THE INVENTION

The coating insert of this invention is used within a coating assembly for defining at least one edge of coating fluid as it is applied to a substrate that is moving in a downweb direction relative to the coating assembly. The coating assembly includes a trough having first and second transverse ends, and a trough opening that extends between the transverse ends, where the trough opening is defined between an upweb edge and a knife edge of the trough. The coating fluid exits the trough opening and is applied to the substrate as the substrate moves past the trough opening. At least one coating insert is inserted within the trough.

The coating insert has a top face with at least one edge-defining surface having first and second ends that define an edge of coated fluid on a substrate. When the coating insert is positioned within the trough so that one edge-defining surface faces the first transverse end of the trough, the first end of this edge-defining surface is further from the knife edge of the trough than the second end of the edge-defining surface. In addition, the second end of the edge-defining surface is further from the first transverse end of the trough than the first end of the edge-defining surface.

Additionally, the top face of the coating insert may include a a second edge-defining surface having first and second ends that may define another edge of coated fluid on a substrate. When the coating insert is positioned within the trough so that the second edge-defining surface faces the second transverse end of the trough, the first end of the second edge-defining surface is further from the knife edge of the trough than the second end of the second edge-defining surface. Additionally, the second end of the second edge-defining surface is further from the second transverse end of the trough than the first end of the second edge-defining surface.

The edge defining-surfaces of the coating inserts may include linear portions, curved portions, or a combination of curved and linear portions. In addition, the coating inserts can have a transverse opening to permit flow of the coating fluid in the transverse direction when a coating insert is inserted within the trough.

DETAILED DESCRIPTION

Figure 3:
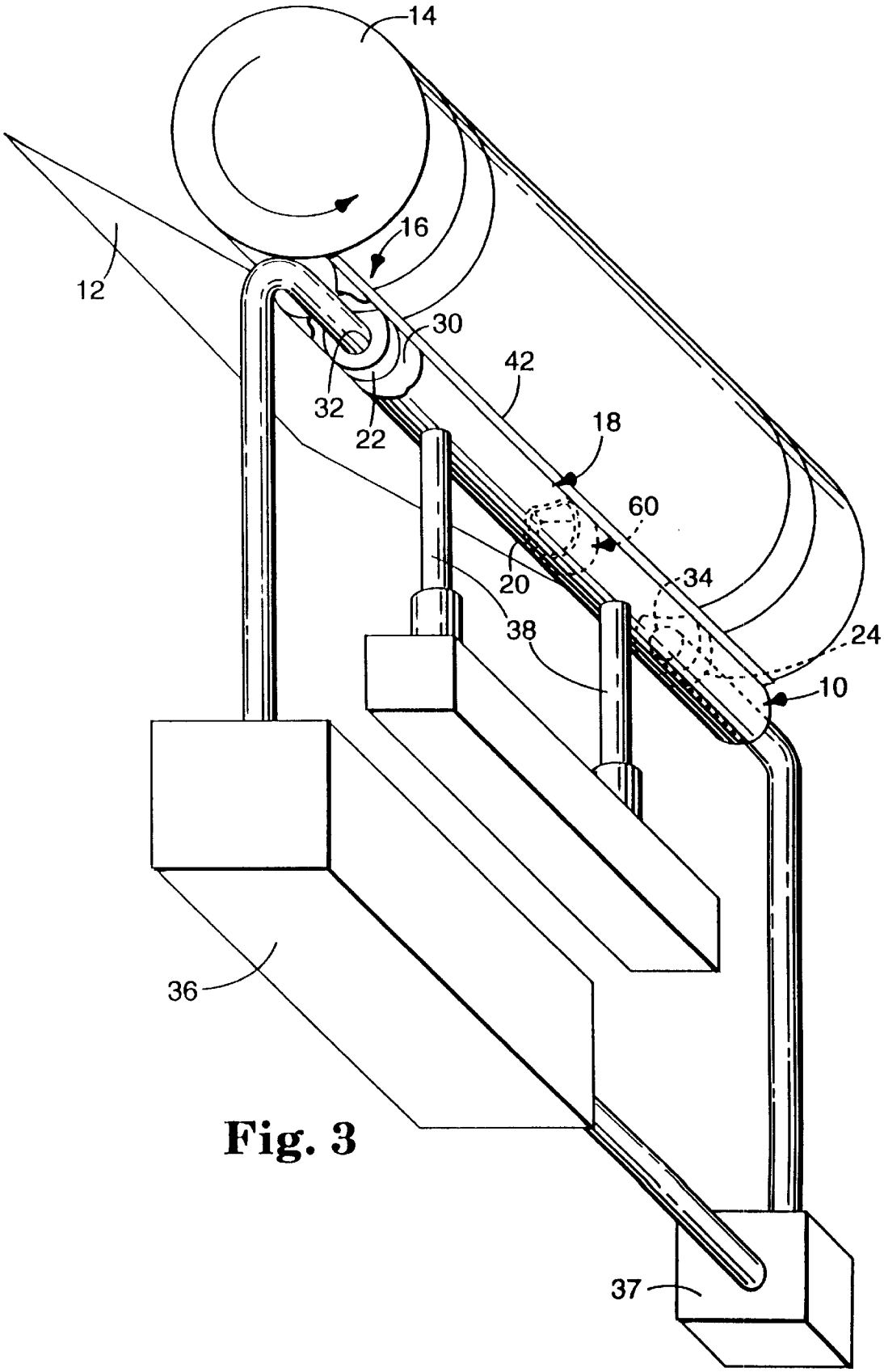
FIG. 3 is a perspective view of a cross flow knife coater.
Figure 4:
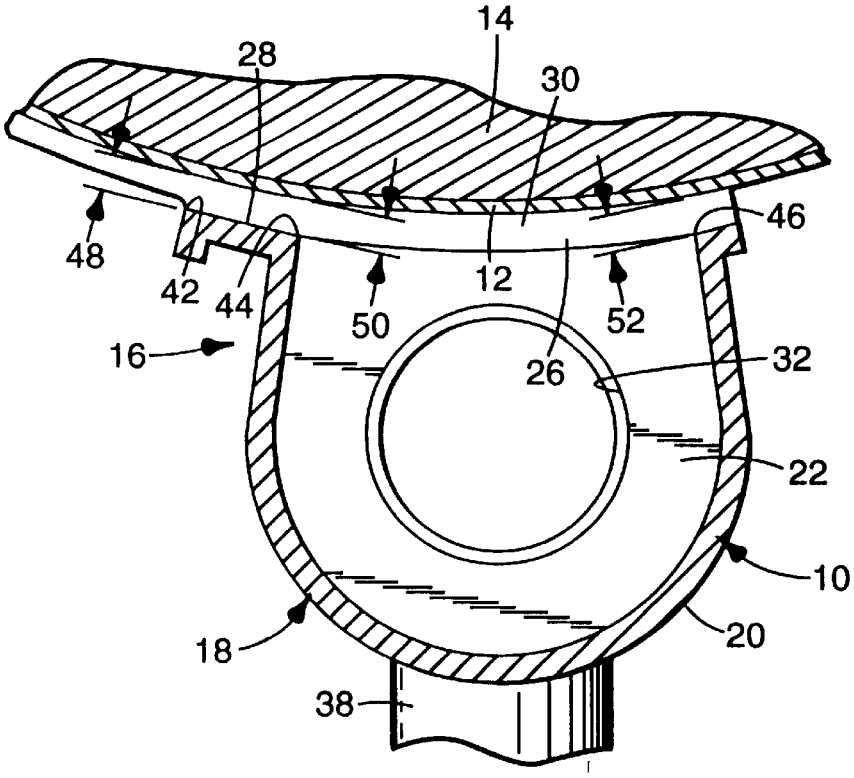
FIG. 4 is a schematic side view of the cross flow knife coater of FIG. 3.

FIGS. 3 and 4 show a cross flow knife coater 10. According to one embodiment, the cross flow knife coater 10 includes a coating station 16 through which a surface to receive coating liquid passes. As shown, the surface is a web 12 passing over and supported against a backup roller 14 which can be deformable. Throughout the specification, knife coaters, including the cross flow knife coater 10, and methods are described with respect to coating a liquid directly on a substrate, such as a web 12, moving around a backup roller 14. Alternatively, coatings can be transferred to the substrate using intermediate components such as transfer rollers and other rollers. Other fluids also can be coated. The substrate can be coated against a backup surface, such as the illustrated backup roller 14, or in a free span. Also, the coater opening need not be beneath the substrate.

The coater 10 includes a trough 18, which extends transversely across at least the desired width of the coating. The trough 18 is defined by a curved wall 20, end dams 22, 24 at either transverse end and a trough opening 26. The web 12 moves through the coating station 16 above the trough opening 26, where the shape of the dams 22, 24 preferably conforms to that of the roller 14 surface. It is understood that during the coating operation, the web 12 generally moves in a direction from the side of an upweb edge 46 of the coating station 16 toward a knife 28, or downweb edge of the coating station 16. Clearance between the trough 18 and dams 22, 24 and the backup roller 14 is sufficient to allow the web 12 to run through the trough 18 as the roller 14 rotates. However, this clearance at the dams 22, 24 should be small to prevent the coating liquid 30 from spilling out over the dams 22, 24. The region of clearance between the web 12 and the downweb side of the trough 18 is the knifing passage, through which the coating liquid 30 flows to form the coating. The knife 28 regulates the thickness of the coating liquid 30 applied on the web 12. The region of clearance between the web 12 and the upweb edge 46 of the trough 18 provides a dynamic seal designed to prevent liquid from flowing out of the trough at that location. The transverse locations of the dams 22, 24 within the trough 18 can be changed to control the width and transverse location of the coating.

This cross flow knife coater 10 can apply coating material 30 across the entire width of a web 12. Alternatively, the cross flow knife coater 10 can be used to apply zones or stripes of coating material 30 of specific widths across the transverse width of the web 12, leaving uncoated areas between those stripes of coating material 30. Stripes can be coated by providing at least one coating insert 60 in the trough 18.

Figure 5:
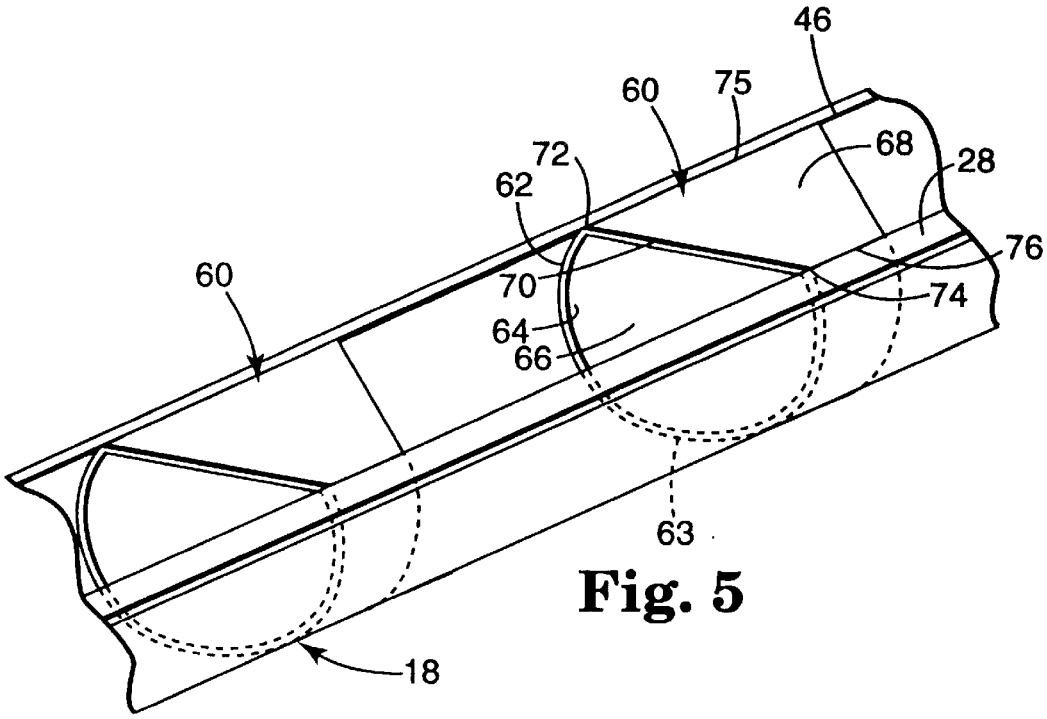
FIG. 5 is a perspective view of a portion of the trough of the cross flow knife coater of FIG. 3, including two coating inserts.
Figure 6:
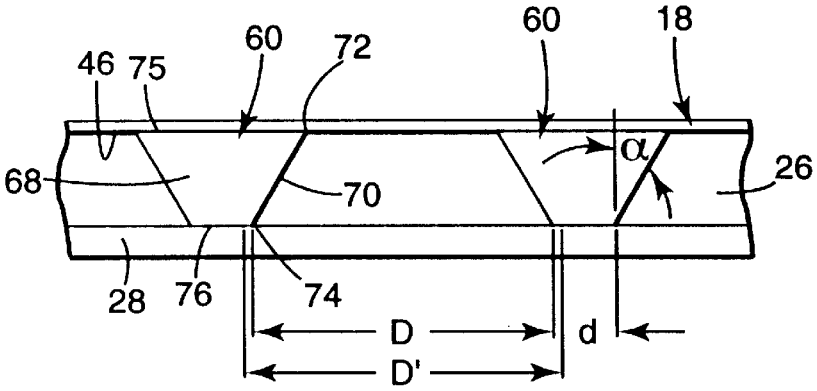
FIG. 6 is a plan view of the portion of the trough of the cross flow knife coater illustrated in FIG. 5.

Referring to FIGS. 5 and 6, in general, coating inserts 60 are designed to block the trough opening 26 in particular areas so that the coating material 30 cannot exit the trough opening 26 and transfer to the web 12 in those areas. Distance D represents the distance between adjacent coating inserts 60 when those coating inserts 60 are positioned within the trough 18, and distance d represents the width of the coating insert 60 at the knife 28. However, in operation the width of the coating liquid 30 applied to the web 12 may be wider than the distance D and is illustrated in FIG. 6 as a distance D'. The difference between the distances D and D' may be referred to as a loss in the uncoated width of the web 12 or as an increase in the coated width of the web 12. Therefore, to obtain a particular width of coating material 30 on the web 12 when operating the cross flow knife coater 12, the position of the coating inserts 60 in the trough 18 must be adjusted to account for the difference between distances D and D', where the reasons for this difference are described in detail below.

The coating inserts 60 can be hollow and include an outer surface 62, an inner surface 64, a thin wall 63 between the outer surface 62 and the inner surface 64, an opening 66, and a top face 68. The top face 68 has a shape that matches the shape of the opposing surface being coated and has at least one edge-defining surface 70, an upstream edge 75, and a downstream edge 76. The outer surface 62 of the coating insert 60 preferably conforms to the inside surface of the curved wall 20 of the trough 18. The shape of the trough 18 is generally constant in a transverse direction so that any coating inserts 60 can slide to a desired position within the trough 18.

When a coating insert 60 is positioned within the trough 18, the edge-defining surface 70 faces one of the transverse ends of the trough 18 and has an upweb end 72 that contacts the upweb edge 46 of the trough 18 and a downweb end 74 that contacts the knife 28. As shown, as the edge-defining surface 70 faces one of the transverse ends of the trough 18, the distance of the downweb end 74 from that transverse end is greater than the distance of the upweb end 72 from that transverse end, and the portion that connects the downweb end 74 and the upweb end 72 is linear. In this embodiment, the transverse width of the top face 68 decreases linearly from the upweb end 72 toward the downweb end 74 of the edge-defining surface 70. However, the upstream edge 75 need not be the widest portion of the coating insert 60 and the downstream edge 76 need not be the narrowest portion of the coating insert 60.

The coating inserts 60 may have only one edge-defining surface 70, where the other side of the coating insert 60 has some other configuration. For instance, a coating insert may be used in place of one or both of the dams 22, 24 to define one edge of coating fluid 30, in which case only one edge-defining surface 70 is necessary. Alternatively, when a coating insert 60 is being used to define two edges of coating fluid 30, the coating insert 60 has two edge-defining surfaces 70.

The coating inserts 60 effect coating processes differently depending on the angle $\alpha$ of the edge-defining surface 70 from the coating direction, shown in FIG. 6. The angle $\alpha$ may be selected to achieve specific stripe coating characteristics across the transverse width of the web 12. For example, one consideration for stripe coating is that under certain coating conditions, the width D' of coating material 30 applied to the web 12 may actually be larger than the width D between the two coating inserts 60. For a given width D, the actual width of the coated stripe can be controlled by varying the angle $\alpha$ of the coating inserts 60, as described below.

Figure 11:
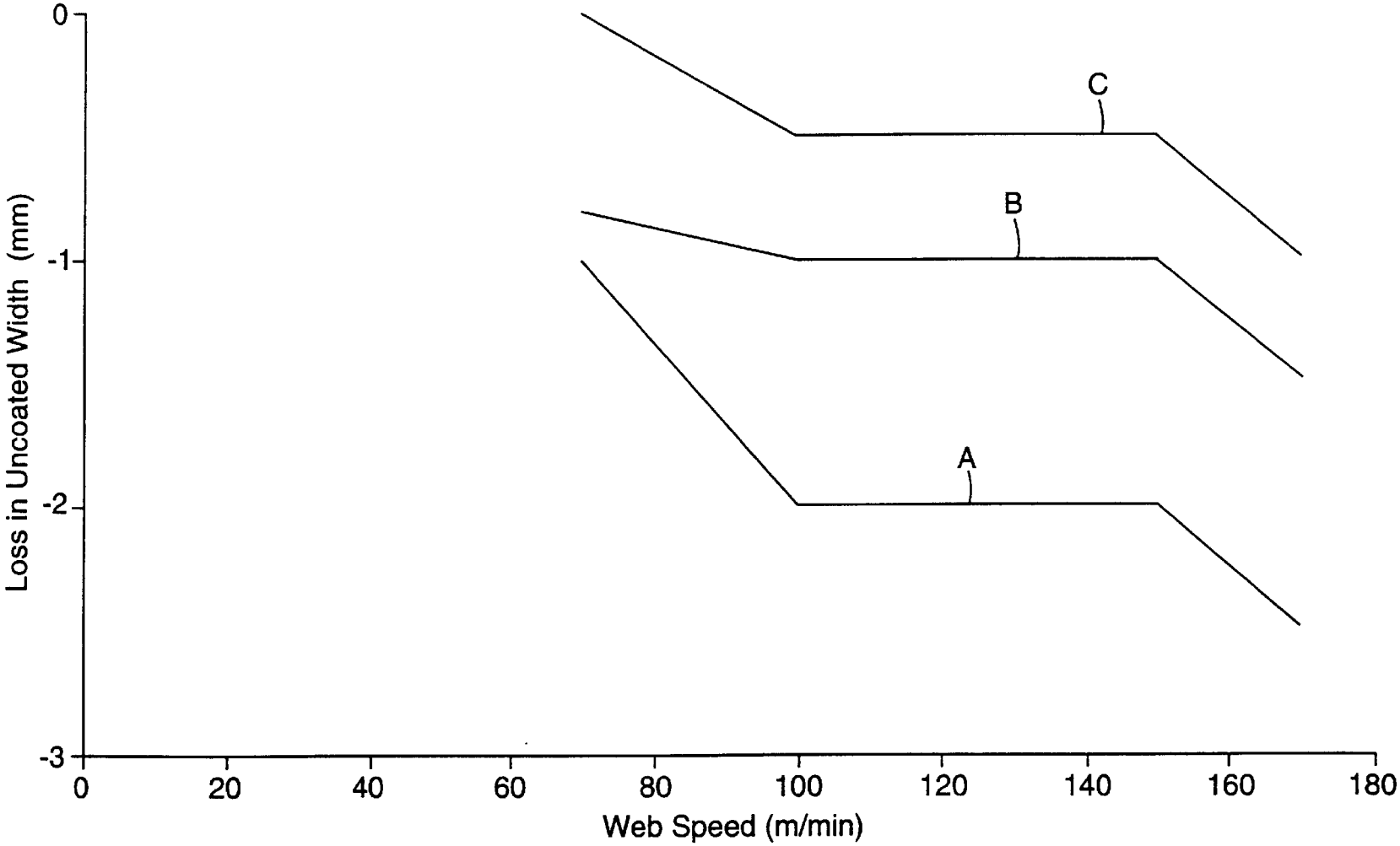
FIG. 11 is a graph illustrating the change in uncoated web width with web speed changes for three different coating inserts.

The effects of the angle $\alpha$ on the coating width are best illustrated in the graph of FIG. 11. In this Figure, representative changes in the width of a coated stripe under similar operating conditions in a cross flow knife coater are illustrated with three coating inserts 60, each with a different angle $\alpha$. For this comparison, each of the coating inserts 60 are used under similar operating conditions, such as coating gap, coating thickness, and the like, and with the same coating materials 30. Specifically, the performance of a coating insert 60 with an angle $\alpha$ of 30 degrees is represented in FIG. 11 as line "A", the performance of a coating insert 60 with an angle $\alpha$ of 15 degrees is represented as line "B", and the performance of a coating insert 60 with an angle $\alpha$ of 0 degrees is represented as line "C".

As shown in FIG. 11, when a web 12 is moving at 70 m/min and a coating insert 60 with an angle $\alpha$ of 15 degrees is used, the loss in uncoated width, or the increase in coated width, is approximately 0.9 mm. As the web speed is increased to 100 m/min, the loss in uncoated width increases to 1 mm. The loss in uncoated width tends to stay constant at about 1 mm from a web speed of 100 m/min to a web speed of about 170 m/min, after which the loss in uncoated width increases to 1.5 mm. This increase in the uncoated width with a corresponding increase in web speed is caused by the higher flow of coating material 30 that is required at higher web speeds. This increase in the flow of coating material 30 causes higher trough pressure within the trough 18 which tends to push liquid into the space between the web 12 and the top face 68 of the coating insert 60.

In many cases, increased width stripes prevent manufacturers from meeting their specifications for coated width tolerances for their products. However, changes in the angle $\alpha$ of the coating insert 60 and changes in web speed can be used to control the variations in uncoated web width, as shown in FIG. 11. Although coating inserts 60 with angles $\alpha$ of 0 degrees through 30 degrees cause the uncoated width to change in a similar manner with changes in web speed (i.e., as the web speed increases, the loss in uncoated width increases), it is shown that increasing the angle $\alpha$ from 0 degrees to 30 degrees significantly decreases the loss in uncoated width at each particular line speed. For example, at 100 m/min, the 0 degree coating insert had a loss of 2 mm in uncoated width, the 15 degree coating insert showed a loss of 1 mm in uncoated width, and the 30 degree coating insert had a loss of approximately 0.5 mm in uncoated width. When the web 12 is moving at 70 m/min, the 30 degree coating insert showed no loss in uncoated width, while the 15 degree insert showed a 0.9 mm loss in uncoated width.

Figure 7:
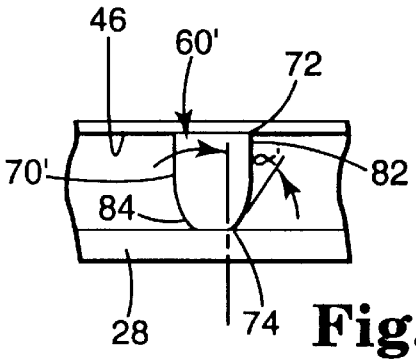
FIG. 7 is a plan view of a coating insert including a top face with linear and curved portions according to another embodiment of the present invention.

The edge defining surface 70 may have multiple linear and curvilinear portions, one example of which is illustrated in FIG. 7. In this embodiment, an edge defining surface 70' of a coating insert 60' has a first portion 82 that is closest to the upweb edge 46 when the coating insert 60' is positioned within the trough 18. The first portion 82 is generally perpendicular to the knife 28 and is linear. The edge defining surface 70' also has a second portion 84 that can be linear or curved. The second portion 84 is angled from the first portion 82 so that the coating insert 60' is wider at the upweb edge 46 than at the knife edge 28. Similar to the coating insert 60, changes in the angle $\alpha'$ of the coating insert 60' effect the loss in uncoated width when applying stripes of coating material 30 in the same way that the angle $\alpha$ of coating inserts 60 effect the loss in uncoated width, as described above.

When each coating insert 60 may have two edge defining surfaces 70, each facing an opposite transverse end of the trough 18, a single coating insert 60 can have one edge defining surface 70 of the type illustrated in FIG. 6, FIG. 7, or of some other type, and that the other edge defining surface 70 can be different. Alternatively, the shape of both of the edge defining surfaces 70 on a single insert 60 may be the same, although angled in opposite directions with respect to the transverse width of the trough 18.

Also, the side of the edge dams 22, 24 that face the transverse center of the trough 18 may include an angled edge defining surface (not shown) as described above with regard to coating inserts 60. An edge defining surface on an edge dam 22, 24 would be specifically used to define the furthest transverse edges of coating material 30 on the web 12. In this case, the end of the edge defining surfaces of the edge dams 22, 24 closest to the knife side of the trough would be used to define the edges of the coating material 30 applied to the web 12. These edge dams 22, 24 can be used with additional coating inserts 60 within the trough 18 for defining stripes or zones of coating material 30, or by themselves. In either case, it is understood that only one of the edge dams 22, 24 may have an angled edge defining surface, that both of the edge dams 22, 24 may have an angled edge defining surface, or that neither of the edge dams 22, 24 may have an angled edge defining surface.

Referring again to FIG. 3, during a coating operation the coating liquid 30 is fed to the trough 18 from a source 36 through a port 32 in one of the dams 22. The coating liquid 30 travels transversely along the length of the trough 18 until it reaches a coating insert 60, if there are any coating inserts 60 within the trough 18. The coating material 30 that is not coated to the web 12 may then pass through the opening 66 in the coating insert 60. The process is repeated along the length of the trough 18 as the coating material 30 encounters other coating inserts 60, if any. Any excess coating liquid 30 that reaches the end of the trough 18 opposite the dam 22 exits through a port 34 through the opposite dam 24 where it can return, as shown in FIG. 3, through a filter or cleaner 37 to the source 36. This port 34 also provides a vent to purge undesirable debris and bubbles which enter the trough 18. The coating liquid 30 is fed by a pump (not shown) at a rate just sufficient to fill the entire trough 18. That rate is equal to the rate at which material leaves the trough opening 26 to be coated, which is controlled by the clearance in the knifing passage, plus the rate of removal of excess coating through the port 34, which is controlled by a valve.

The size and shape of the opening 66 in the coating insert 60 can differ depending on the requirements of a specific coating application; or it can be selected simply for ease of fabrication and reduction of material and cost of manufacturing. In some cases, it will be desirable to minimize the resistance encountered by a coating liquid 30 as it moves transversely across the trough 18. In these cases, the opening 66 of the coating insert 60 and should be large as shown in FIG. 5, where only a thin wall 63 of material is provided between the inner surface 64 and the outer surface 62, thus maximizing the area of the opening 66.

Figure 10:
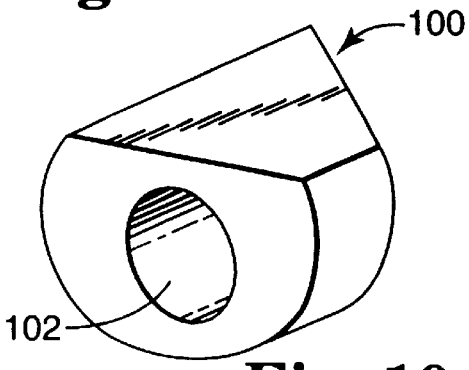
FIG. 10 is a perspective view of a coating insert according to another embodiment of the present invention.

Alternatively, when the resistance encountered by the coating liquid 30 during a coating operation is not a concern, an opening 102 in a coating insert 100 may be smaller than the opening 66 in coating insert 60, as illustrated in FIG. 10. In this embodiment, the opening 102 is a generally circular hole in a transverse direction through the coating insert 100. However, the opening 102 need not be circular.

Figure 8:
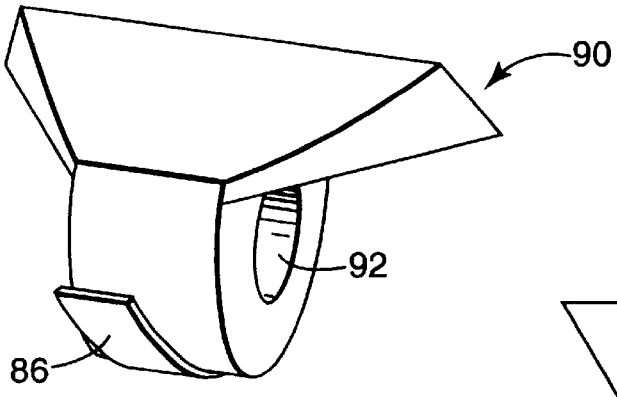
FIG. 8 is a perspective view of a coating insert according to another embodiment of the present invention.
Figure 9:
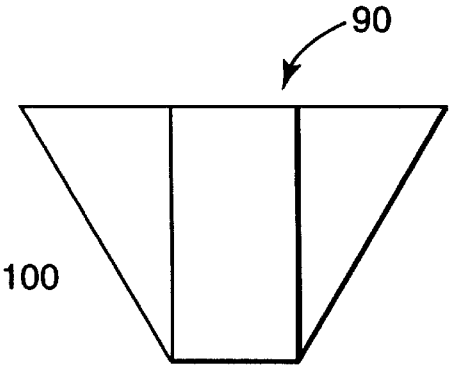
FIG. 9 is a bottom view of the coating insert illustrated in FIG. 8.

FIG. 8 illustrates another alternative coating insert 90 having an opening 92 provided in a transverse direction through the coating insert 90, which may be generally circular or may be some other shape. In this embodiment, the width of the coating insert 90 at most points in a direction perpendicular to the transverse direction varies from below the opening 92 to above the opening 92. FIG. 9 illustrates a bottom view of the coating insert 90 of FIG. 8 and further illustrates that the width is smaller at the bottom of the coating insert 90 than at the top of the coating insert 90 at most points in a direction perpendicular to the transverse direction.

The knife 28 can be a separate element attached to the trough curved wall 20 or it can be a surface of the curved wall. Also, the knife 28 can be planar, curved, concave, or convex. The knife 28 or the backup roller 14 can be flexible, with the gap between the trough 18 and the web 12 being sustained by hydrodynamic pressure.

The cross flow knife coater 10 also includes a system which adjusts the distance between the knife 28 and the web 12. This adjustment system can include actuators 38 mounted on supports on each end of the trough 18. As shown in FIG. 3, the same actuators 38 can be used for adjusting the knife clearance and moving the trough 18. Because the liquid pressure near the inlet end or port 32 of the trough 18 is slightly greater than that near the outlet end or port 34, the knifing clearance must be slightly smaller at the inlet end or port 32 than at the outlet end or port 34 to achieve a transversely uniform coating. The adjusting system can provide independent adjustment of the knifing clearance at either end, and the actuators 38 can operate independently of each other.

The adjustment system may also counter gravitational, hydrodynamic, thermal, or other stresses which tend to warp the trough 18, the knife 28, and the backup roller 14, thereby resulting in nonuniform deposition of coating across the web 12. Such countering forces can be achieved, for example, with an embedded, fluid filled bladder (not shown) beneath the trough 18 and extending across the web, or by the discrete micro-flexible mounts or tuning bolts positioned across the web 12, or by additional actuators 38 between the ends of the trough. Alternatively, the knife 28 and trough 18 assembly can be formed sufficiently rigidly to prevent deflection. Regardless, the trough 18 and knife 28 should be retractable from the backup roller 14 for splice passage, coat-outs, and changeovers.

The trough may be any shape, although it is preferred that it have smooth, continuous walls, as shown, to avoid stagnation of coating liquid, as would occur at corners. The trough 18 is undercut from its opening at the top to hold the edge dams 22, 24 and any coating inserts 60 in the trough 18, thereby allowing only linear transverse movement. The trough 18 can be located directly beneath the backup roller 14 to avoid spilling any coating fluid 30 when the trough 18 is retracted from the roller 14.

The coating inserts 60 may further include a positioning device 86 for positioning the coating insert 60 in the vertical direction relative to the knife 28 and the upweb edge 46, as illustrated in FIG. 8. The positioning device 86 can be used to push the coating insert 60 upward within the trough 18 toward the backup roller 14. The positioning device 86 insures a tight seal between the coating insert 60 and the trough 18 so that coating material 30 may not flow between the outer surface 62 of the insert 60 and the curved wall 20 of the trough 18 and on to the top face 68 of the coating insert 60. Examples of positioning devices 86 include a leaf spring installed on the bottom of the coating insert 60 and a screw inserted vertically through the coating insert 60.

The shape of the trough 18 is constant transversely so that the outside shapes of the edge dams 22, 24 and any coating inserts 60, which conform to the inside shape of the trough 18, can slide to any position and can be removed easily to facilitate cleaning. The opening 26 at the top of the trough 18 can be wide enough to allow access with fingers or appropriate tools for cleaning the walls of the trough 18 when the trough is moved away from the web 12. The trough 18 opening 26 is much wider than a slot used in slot coating. (Slots typically have a width between 0.00254 and 0.254 cm (0.001 and 0.100 inch) in known commercial operations.)

The cross-sectional area of the trough 18 is large enough to insure a low operating pressure in the trough 18, but is small enough to avoid excessive material waste during changeover. Low trough pressure reduces the separating force between the trough 18 and the backup roller 14, and helps to prevent a break in the dynamic seal.

The coating liquid 30 enters the trough 18 from one transverse end, through the port 32 in the dam 22 and moves across the trough 18 transverse to the direction of web movement. As the coating liquid 30 is applied to the web 12, the web movement in a downweb direction combines with the transverse direction of coating liquid flow across the trough 18 to create a spiral coating liquid flow. Bubbles, gels, or debris particles entering the trough 18 with the coating fluid 30 have been observed to remain in the spiral flow rather than to enter the knifing passage. The slight venting flow through the outlet port 34 purges these and other undesirables. This flow greatly reduces the potential for downweb streaks caused by bubbles, gels, or debris particles entrapped in the knifing passage.

Referring to FIG. 4, the knife 28 has a downweb trailing edge 42 and an upweb leading edge 44 collinear with the intersection of the surface of the edge dams 22, 24 and any coating inserts 60 facing the web 12 and the wall of the trough 18 on the downweb side. The trough 18 also has an opposing, upweb edge 46. The trailing knife edge 42 locates the intersection of the coating liquid 30, the knife 28, and the surrounding air, from which the top side of the coating extends. The knife surface and the wall of the trough need not necessarily be discontinuous. The upweb trough edge 46 locates the intersection of the coating liquid 30, the trough 18, and the surrounding air from which a liquid-air interface extends to the intersection of the coating liquid 30, the web 12, and the surrounding air, from which the bottom side of the coating extends. As shown, the top surface of the dams 22, 24 are flush with the upper edges of the trough 18, as are the top faces 68 of any coating inserts 60 located within the trough 18. Alternatively, the top surface could be raised above the upper edges to allow a large clearance in the knifing passage, such as for thick coatings, without allowing transverse seepage of liquid past the dams 22, 24 and any coating inserts 60.

The perpendicular distance 48 from the web 12 to the trailing knife edge 42 is preferably less than twice the thickness of the coated liquid and is the narrowest gap between the web 12 and the knife 28. It may vary slightly from the inlet to the outlet ends of the trough 18 to achieve a uniform coating. The perpendicular distance 50 from the web 12 to the leading knife edge 44 should be slightly greater than the distance 48 to insure a decreasing clearance through the knifing passage to the trailing edge 42 (that is, to provide a shallowly convergent knifing passage). The shape of the knife surface between its edges 42, 44 may be flat, slightly concave, or slightly convex. The length of this surface should be at least ten times greater than the distance 48. The perpendicular distance 52 from the web 12 to the edge 46 is approximately equal to the distance 50. The distance along the top of the trough 18, between the downweb trough edge (which is collinear with the leading knife edge 44) and the upweb trough edge 46 is sufficiently large to allow ready access to the trough 18 for cleaning when the trough 18 is retracted from the web 12 and the backup roller 14.

Various changes and modifications can be made in the invention without departing from the scope or spirit of the invention. For example, the invention is easily adapted to a configuration in which multiple coating inserts are secured in spaced relation to each other by a bar, rod, or the like. This can be useful in manufacturing to minimize the time required to properly position coating inserts relative to one another within a trough; when setting up a process, an operator would simply slide an entire coating insert configuration into a trough and would not need to adjust the coating inserts relative to one another.

Figure 1:
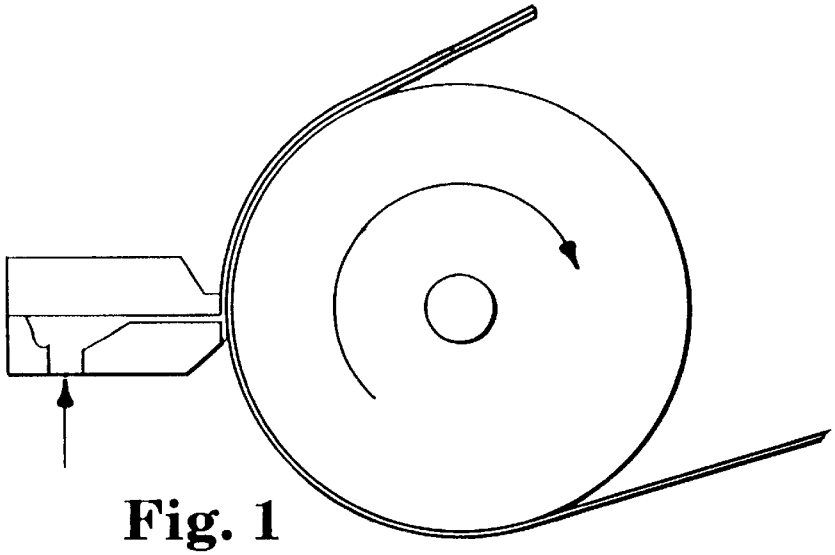
Fig. 1 PRIOR ART
FIG. 1 is a schematic view of a die fed knife coater.
Figure 2A:
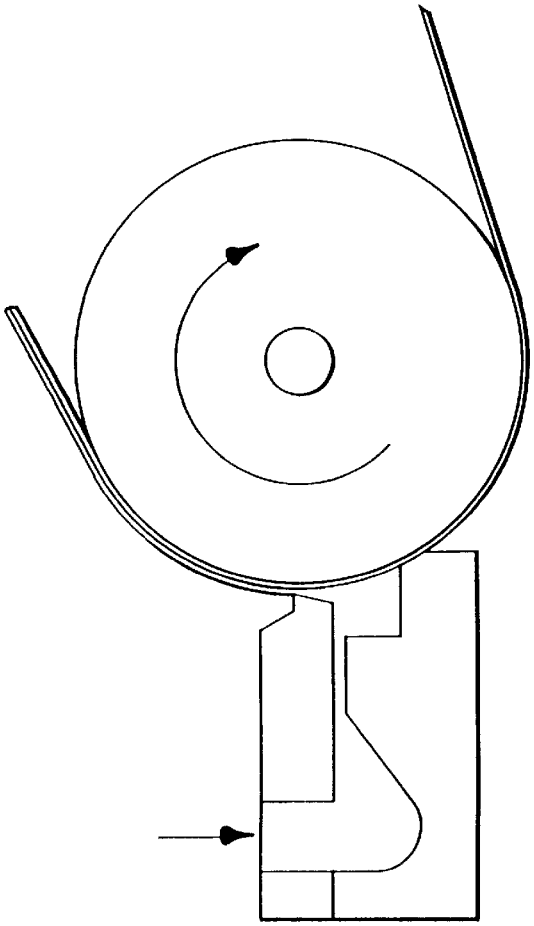
Fig. 2A PRIOR ART
FIGS. 2A and 2B are schematic views of trough-fed knife coaters.
Figure 2B:
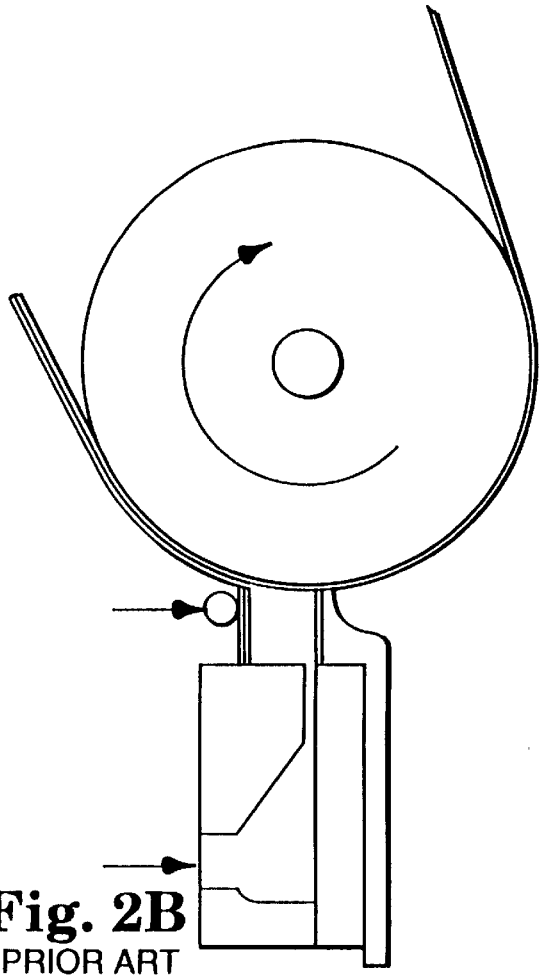
Fig. 2B PRIOR ART

Also, the coating inserts of the present invention can be used within coaters other than cross flow knife coaters. For example, the coating inserts of the present invention can be inserted within the trough of a trough-fed knife coater of the type illustrated in FIGS. 2A and 2B. These coating inserts can have characteristics similar to that of the coating inserts 60, 90, and 100. However, since flow of coating material across the transverse width of the trough is not required for these trough-fed knife coaters, the transverse openings in the coating inserts (shown as 66, 92, and 102 in FIGS. 5, 8, and 10 respectively) are not necessary for coating inserts used in these trough-fed knife coaters.

We claim:

1. A coating insert for use within a coating assembly which applies a coating fluid to a substrate as the substrate is moved in a downweb direction relative to the coating assembly, wherein the coating assembly includes a trough with an upweb edge, a knife edge opposite the upweb edge, a trough opening between the upweb edge and the knife edge that is open to the substrate so that the coating fluid can be applied to the substrate as it moves past the trough opening, a first transverse end, and a second transverse end opposite the first transverse end, wherein the trough has a width between the first transverse end and the second transverse end, and wherein the coating insert is insertable within the trough and comprises:

a top face having at least one edge-defining surface for facing the first transverse end and for defining an edge of a coating applied to a substrate when the coating insert is positioned within the trough of a coating assembly, wherein the edge-defining surface has a first end and a second end, wherein the first end is spaced further from the knife edge of the trough when the coating insert is positioned within the trough of a coating assembly than the second end, and wherein the second end is further from the first transverse end than the first end when the coating insert is positioned within the trough of a coating assembly;

an outer surface;

an inner surface; and a wall connecting the outer and inner surfaces, wherein the inner surface defines a transverse opening to permit flow of a coating fluid through the coating insert when the coating insert is positioned within the trough of a coating assembly.

2. The coating insert of claim 1, wherein the edge-defining surface between the first end and the second end is linear.

3. The coating insert of claim 1, wherein the edge-defining surface between the first end and the second end is curved.

4. The coating insert of claim 1, wherein the edge-defining surface between the first end and the second end comprises at least one linear portion and at least one curved portion.

5. The coating insert of claim 1, wherein the top face of the coating insert further comprises a second edge-defining surface for facing the second transverse end of the trough when the coating insert is positioned within the trough of a coating assembly and for defining an edge of a coating applied to a substrate, wherein the second edge-defining surface has a first end and a second end, wherein the first end of the second edge-defining surface is spaced further from the knife edge of the trough when the coating insert is positioned within the trough of a coating assembly than the second end of the second edge-defining surface, and wherein the second end of the second edge-defining surface is further from the second transverse end than the first end of the second edge-defining surface when the coating insert is positioned within the trough of a coating assembly.

6. The coating insert of claim 1, further comprising a means for positioning the coating insert within the trough relative to the knife edge and the upweb edge when the coating insert is positioned within the trough of a coating assembly.

7. A coating assembly which applies a coating fluid to a substrate as the substrate is moved in a downweb machine direction relative to the coating assembly, wherein the coating assembly comprises:

means for feeding coating fluid to the coating assembly;

a trough comprising an upweb edge, a knife edge opposite the upweb edge, a trough opening between the upweb edge and the knife edge that is open to the substrate so that the coating material can be applied to the substrate as it moves past the trough opening, a first transverse end, and a second transverse end opposite the first transverse end, wherein the trough has a width between the first transverse end and the second transverse end;

means for flowing the coating fluid across the width of the trough while the coating fluid exits the trough opening; and at least one coating insert inserted within the trough, the coating insert comprising at least one edge-defining surface facing the first transverse end of the trough for defining an edge of a coated substrate, the edge-defining surface having a first end and a second end, wherein the first end is spaced further from the knife edge of the trough than the second end, and wherein the second end is further from the first transverse end than the first end when the coating insert is positioned within the trough of a coating assembly.

8. The coating assembly of claim 7, wherein the flowing means comprises flowing the coating fluid across the width of the trough from one of the first or second transverse ends of the trough to the other transverse end.

9. The coating assembly of claim 8, wherein the coating insert further comprises a second edge defining surface for facing the second transverse end of the trough, the second edge defining surface having a first end and a second end, wherein the first end of the second edge-defining surface is spaced further from the knife edge of the trough than the second end of the second edge-defining surface, and wherein the second end of the second edge-defining surface is further from the second transverse end than the first end of the second edge-defining surface.

10. The coating assembly of claim 8, wherein the coating insert further comprises an outer surface, an inner surface, and a wall connecting the outer and inner surfaces, wherein the inner surface defines a transverse opening to permit flow of the coating fluid through the coating insert.

11. The coating assembly of claim 7, further comprising a plurality of coating inserts.

12. The coating assembly of claim 11, wherein the plurality of coating inserts are spaced from each other for defining at least one stripe of a coated substrate.

13. The coating assembly of claim 12, further comprising means for fixing the plurality of coating inserts in spaced relation to each other.

14. The coating assembly of claim 7, wherein at least one of the coating inserts comprises a single edge-defining surface.

15. The coating assembly of claim 7, further comprising a means for positioning the at least one coating insert within the trough relative to the knife edge and the upweb edge.

* * * * *